US006452508B2

(12) United States Patent
Sturiale

(10) Patent No.: US 6,452,508 B2
(45) Date of Patent: Sep. 17, 2002

(54) AUTOMATIC CLEANING DEVICE FOR A VEHICLE TRAFFIC DETECTING DEVICE

(75) Inventor: Santi Sturiale, Cesano Boscone (IT)

(73) Assignee: Hubbell Incorporated, Orange, CT (US)

( * ) Notice: Subject to any disclaimer, the term of this patent is extended or adjusted under 35 U.S.C. 154(b) by 23 days.

(21) Appl. No.: 09/772,442

(22) Filed: Jan. 30, 2001

Related U.S. Application Data

(63) Continuation of application No. 09/590,998, filed on Jun. 9, 2000.

(51) Int. Cl.[7] ..... G08G 1/04

(52) U.S. Cl. ..... 340/942; 340/943; 340/555; 340/556; 340/557; 340/551; 15/100; 15/102; 15/104.92; 15/245

(58) Field of Search ..... 340/942, 943, 340/555, 556, 557, 551; 15/100, 102, 104.92, 245

(56) References Cited

U.S. PATENT DOCUMENTS 4,363,154 A * 12/1982 Lee ..... 15/102
4,436,412 A * 3/1984 Yamagata et al. ..... 355/15
4,465,362 A * 8/1984 Tohma et al. ..... 355/15
5,806,125 A * 9/1998 Shockley et al. ..... 15/102

* cited by examiner

*Primary Examiner*—Jeffery Hofsass
*Assistant Examiner*—Tai T. Nguyen
(74) *Attorney, Agent, or Firm*—Roylance, Abrams, Berdo & Goodman, L.L.P.

(57) ABSTRACT

A vehicle traffic detecting device is provided with an automatic cleaning device. The detecting device has an emitter and a receiver facing each other and respectively emitting and receiving a beam of electromagnetic radiation along opposite ends of a beam path. The cleaning device has first and second cleaning units for respectively cleaning the emitter and the receiver. Each cleaning unit includes a fastener fastening the cleaning unit to a casing of the detecting device, a dispenser dispensing a transparent film, a contoured guide defining a film path along which the dispensed film resides, and an actuator for moving the dispensed film along the defined film path. A portion of the defined film path is located in front of the emitter/receiver of the detecting device and thereby positions a portion of the dispensed film in front of the emitter/receiver of the detecting device. The cleaning device also has a controller for automatically activating the actuators of the cleaning units in response to a predetermined signal from the detecting device signifying that at least one of the portions of the dispensed films currently in front of the emitter and receiver of the detecting device is fouled. The actuators when actuated move each of the dispensed films a distance along the film path such that the fouled portion(s) are moved beyond the front of the emitter/receiver and the portion of the dispensed film newly in front of the emitter/receiver is clean.

16 Claims, 3 Drawing Sheets

AUTOMATIC CLEANING DEVICE FOR A VEHICLE TRAFFIC DETECTING DEVICE

This application is a continuation of application Ser. No. 09/590,998, filed Jun. 9, 2000.

CROSS-REFERENCE TO RELATED APPLICATIONS

This application claims priority from Italian Utility Model Application No. MI99U000449, filed Jul. 13, 1999 and hereby incorporated by reference.

FIELD OF THE INVENTION

The present invention relates to an automatic cleaning device for a vehicle traffic detecting device, which provides for ensuring long-term, maintenance-free efficiency of the detecting device, even in heavy traffic conditions in which the performance and efficiency of the detecting device are rapidly impaired by severe pollutant emissions and atmospheric agents. The invention also extends to an integrated assembly comprising a vehicle traffic detecting device and an automatic cleaning device therefor.

BACKGROUND OF THE INVENTION

As is known, vehicle traffic—for example, at a tollway tollbooth—is detected by means of detecting devices, e.g. optical, normally defined by a light beam emitter and a corresponding receiver. When the beam is cut off by a vehicle passing between the emitter and receiver, the device detects the passage of a vehicle. A number of pairs of emitters/receivers can be used to also determine the type (in particular, size) and speed, etc. of the vehicle. The beam generating and receiving components of the emitter and receiver are normally housed in corresponding casings and protected by corresponding transparent surfaces through which the beam travels. As should be appreciated, for detecting devices of this sort to function correctly, the transparency of the surfaces protecting the internal components must be maintained. A major drawback of detecting devices of this sort, however, is rapid fouling, particularly of the transparent surfaces, by pollutant substances contained in vehicle exhaust gas, and by atmospheric agents such as dust, rain, and the like. The problem is further compounded in the case of devices used at tollway tollbooths and the like for not only detecting traffic but also for opening/closing pay toll barriers. In which case, being located in a high exhaust gas density area, the device is subject to rapid fouling and, to work properly, must be cleaned frequently, which, at present, is done by hand by an operator at relatively high cost.

It is an object of the present invention to provide an automatic cleaning device for a vehicle traffic detecting device, designed to provide a straightforward, low-cost solution to the above problem.

SUMMARY OF THE INVENTION

According to the present invention, there is provided an automatic cleaning device for a vehicle traffic detecting device, characterized by comprising at least one cleaning unit, in turn comprising: fastening means for assembly to a casing of said detecting device; dispensing means for dispensing a transparent film; actuating means for feeding said film along a predetermined path and positioning said film in front of said detecting device; and control means for automatically activating said actuating means in response to a predetermined signal from said detecting device.

The invention also relates to an integrated assembly comprising a vehicle traffic detecting device and an automatic cleaning device; said detecting device comprising an emitter and a receiver for respectively emitting and receiving a beam of electromagnetic radiation, and which are located facing each other at respective opposite ends of a path of said beam; the integrated assembly being characterized by comprising a cleaning device, in turn comprising a first and a second cleaning unit for respectively cleaning said emitter and said receiver, and control means for automatically activating said cleaning units; said cleaning units comprising respective dispensing means for dispensing respective transparent films, and respective actuating means for feeding said films along respective predetermined paths and positioning said films respectively in front of said emitter and said receiver; said control means activating said actuating means of both said cleaning units in response to a predetermined variation in said beam.

The cleaning device according to the invention therefore provides for ensuring long-term efficiency of the detecting device, while at the same being extremely cheap and easy to produce and assemble, and cheap to run. Featuring a roll-up film, the cleaning device, in fact, provides for guaranteed efficiency of the detecting device at all times. That is, according to the invention, it is the transparent films protecting the detecting device components (in particular, closing the openings of the emitter and receiver of the detecting device) which are directly exposed to external pollutants. When the portion of film over the emitter or receiver becomes so dirty as to fail to ensure correct operation of the detecting device, the actuating means of both the emitter and receiver cleaning units are activated to feed the films of both cleaning units forward and position respective clean portions of film in the work position in front of the respective openings of the emitter and receiver. The film feed actuating means may advantageously be activated in response to a prolonged interruption—over and above a predetermined minimum period of time—of the beam between the emitter and receiver.

When the reel of film each cleaning unit is provided with runs out, the cleaning units can be opened to change the drums alone, or the cleaning units as a whole may be changed. This is particularly easy, especially when, as in a preferred embodiment of the invention, the cleaning units are of modular design. In which case, the cleaning units can also be fitted easily, with only minor alterations, to existing detecting devices. According to the invention, in fact, the roll-up-film cleaning units may either be produced separately and fitted to existing detecting devices, or be integrated in the detecting devices themselves.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 4:
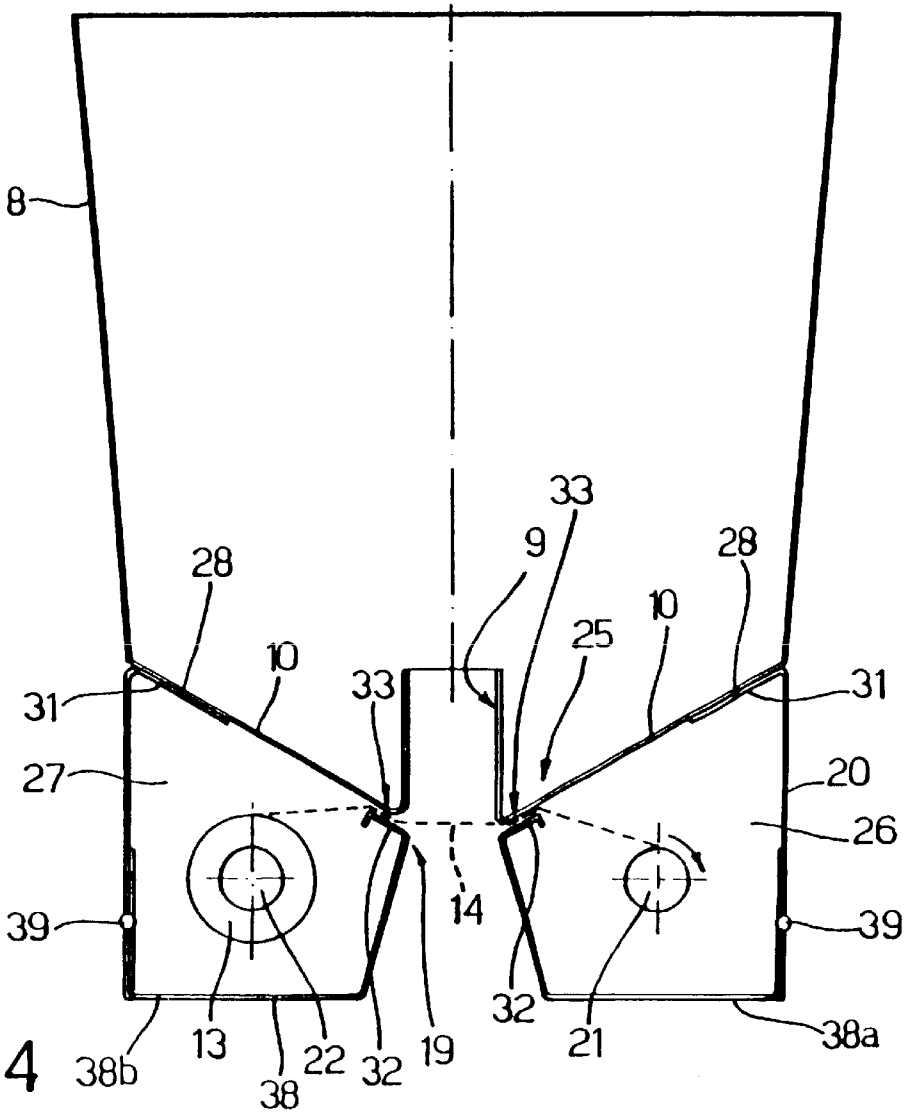
FIG. 4 shows a detailed view of a casing of FIG. 1.

With reference to the accompanying drawings, number 1 indicates as a whole an integrated assembly comprising a vehicle traffic detecting device 2 and an automatic cleaning device 3. Detecting device 2 may be of any known type. As shown, the detecting device 2 includes and optical device comprising an emitter 4 and a receiver 5 for respectively emitting an receiving a light beam 6. Emitter 4 and receiver 5—which are know and therefore not described in detail for the sake of simplicity—are located facing each other at respective opposite ends of a path 7 of beam 6, and are housed inside corresponding casings 8 having corresponding windows 9 aligned along path 7 of beam 6. In the example shown, casings 8 housing emitter 4 and receiver 5 are defined by hollow, prismatic box bodies having windows 9 in the form of longitudinal slits formed through respective front walls 10 of casings 8.

Figure 1:
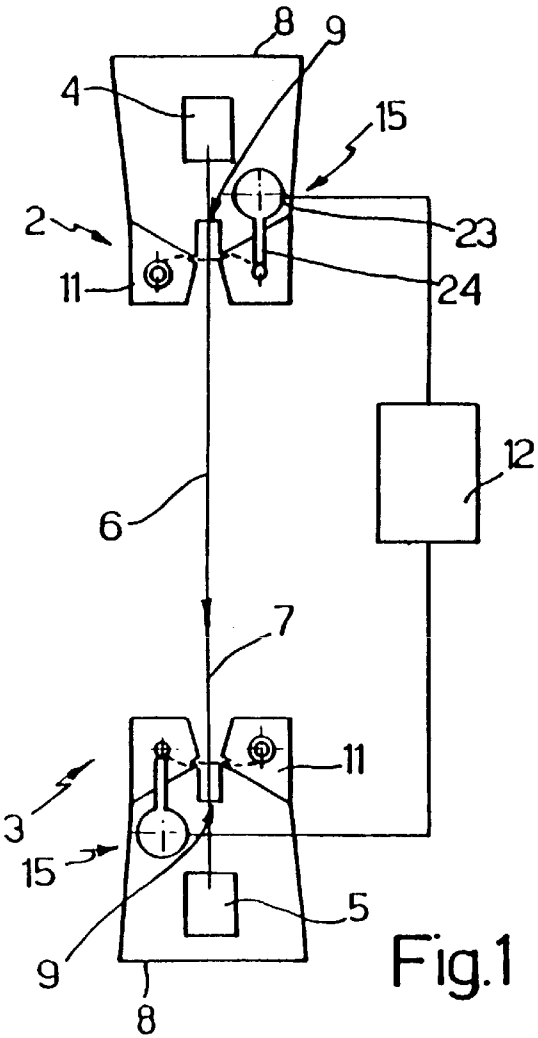
FIG. 1 shows, schematically, an integrated assembly comprising a vehicle traffic detecting device and automatic cleaning device in accordance with the invention.

Cleaning device 3 comprises respective identical cleaning units 11 for emitter 4 and receiver 5; and a controller 12 for automatically and simultaneously activating both cleaning units 11. As seen in FIG. 4, cleaning units 11 in turn comprise respective reels 13 of respective transparent films 14; and respective actuators 15 (FIG. 1) for feeding films 14 along respective predetermined paths and positioning films 14 in front of respective windows 9 of emitter 4 and receiver 5. According to the invention, the controller 12 (which may be of any known type) activates actuator 15 of both cleaning units 11 in response to a predetermined variation in beam 6, e.g. when beam 6 from emitter 4 fails to be received by receiver 5 for a continuous period of time over and above a predetermined minimum value.

Figure 2:
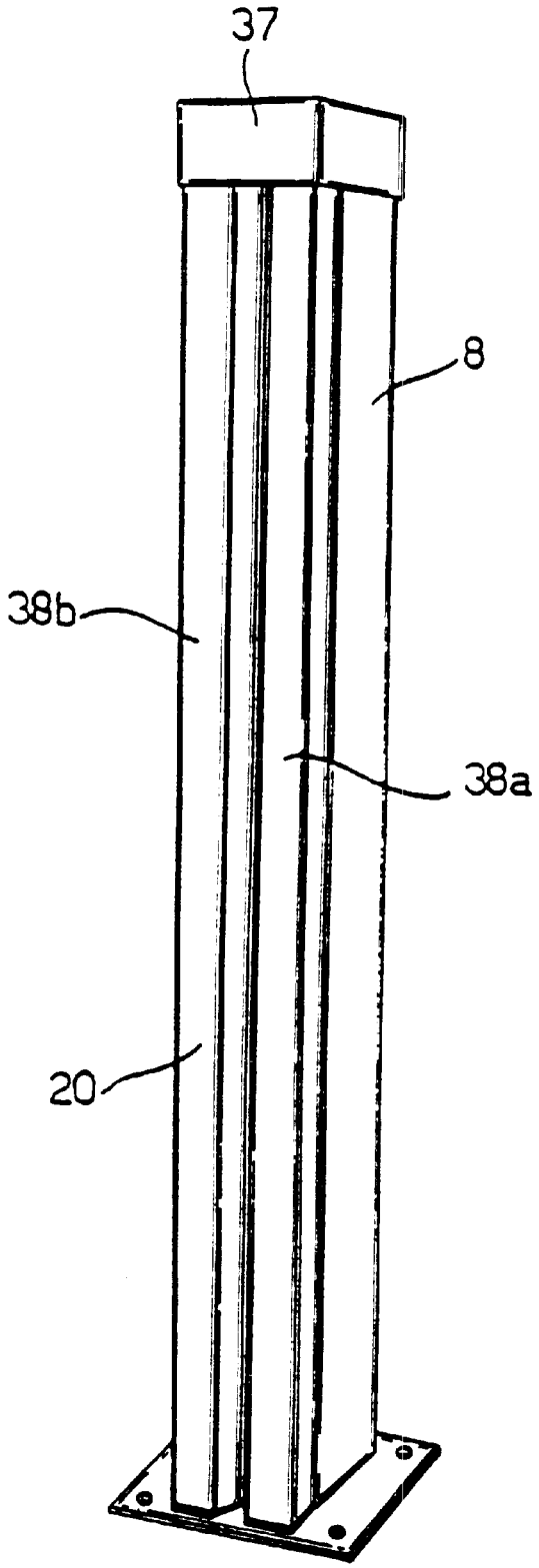
FIG. 2 shows a perspective view of a casing of the FIG. 1 integrated assembly in the work configuration.
Figure 3:
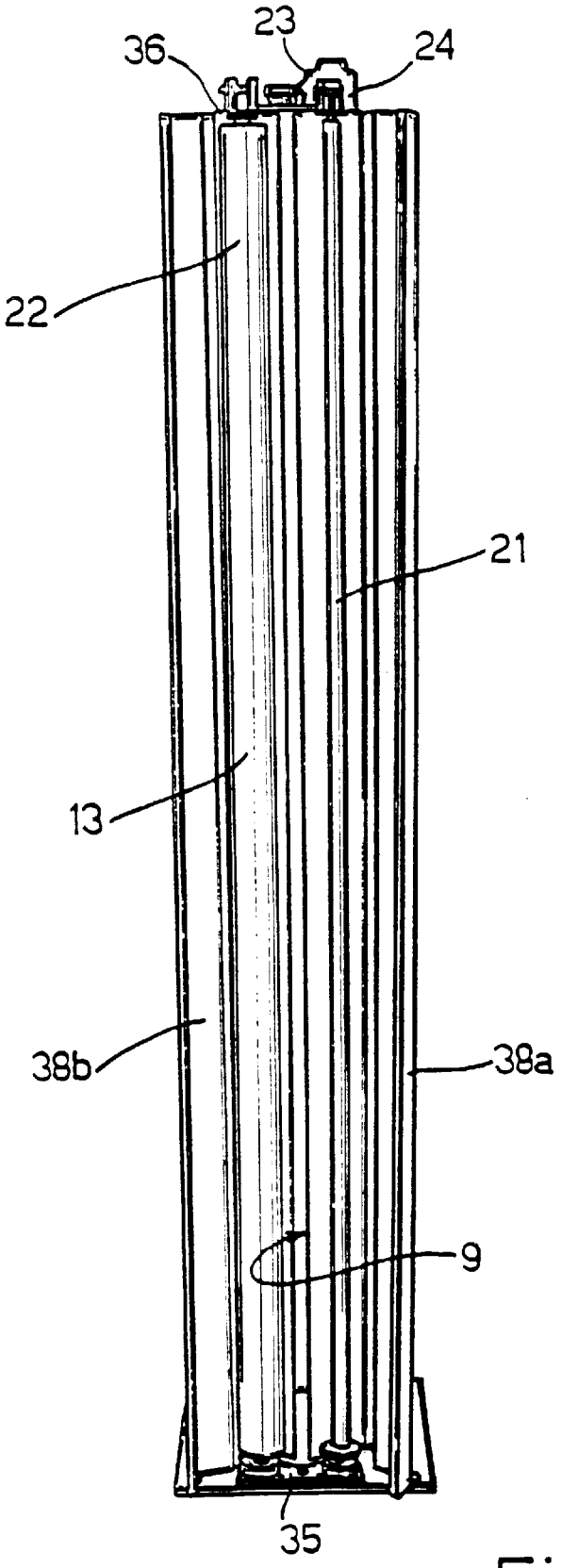
FIG. 3 shows a perspective view similar to that of FIG. 2, with parts of the casing removed for clarity.

Each cleaning unit 11 comprises a box body 20 (FIGS. 2–4) having an opening 19 aligned with corresponding window 9, and housing a first drum 21 onto which film 14 is wound, and a second drum 22 from which film 14 is unwound (and which supports reel 13); which drums respectively define the end point and starting point of the path of film 14. The actuator 15 of each cleaning unit 11 comprises a motor 23 (e.g. electric); and a transmission 24 for transmitting motion from motor 23 to first drum 21 onto which film 14 is wound (both motor 23 and transmission 24 are known and therefore not described or illustrated in detail for the sake of simplicity). The actuator 15 of each cleaning unit 11 also comprises a contoured guide 25 to position respective film 14 in front of, and closing, corresponding window 9 of casing 8.

In the non-limiting example shown in the accompanying drawings, box body 20 of each cleaning unit 11 comprises a first and second hollow body 26, 27 respectively housing first and second drum 21, 22. Hollow bodies 26, 27 of each cleaning unit 11 are defined by respective box elements made of bent sheet metal and so shaped that respective first end edges 31 are connected integrally to front wall 10 of respective casing 8 by appropriate known fasteners 28 (e.g. screws), while respective second edges, opposite edges 31, are positioned facing and a predetermined distance from front wall 10 to define corresponding opposite portions of guide 25, and corresponding gaps 33 located on either side of corresponding window 9 and through which film 14 is inserted.

Hollow bodies 26, 27 of each cleaning unit 11 are connected mechanically to each other at opposite longitudinal ends by a bottom plate 35 and a top plate 36 (FIG. 3), which have holes inside which rotate respective rotation pins of drums 21, 22. Over top plates 36 and closing respective box bodies 20, cleaning units 11 comprise respective cover boxes 37 (FIG. 2) fitted in known manner to top plates 36 and housing corresponding motors 23 and corresponding transmissions 24.

To change and enable access to drums 21, 22, box body 20 of each cleaning unit 11 comprises a removable cover connected to box body 20 in any known manner. In the example shown, cover comprises two portions 38*a*, 38*b* (FIG. 4) defined by respective hinged portions, pivoting on respective hinges 39, of the front walls of hollow bodies 26, 27.

The integrated assembly according to the invention operates as follows. When the dirt deposited on the portions of films 14 in front of windows 9 cuts off beam 6 between emitter 4 and receiver 5 (thus impairing operation of detecting device 2) for a prolonged period of time over and above a given threshold, a corresponding signal is sent to the controller 12, which activates actuator 15 of both cleaning units 11 of emitter 4 and receiver 5, so that the soiled portions of films 14 are wound onto respective drums 21, and clean portions of films 14 are unwound off respective reels 13 (carried on drums 22) and positioned at openings 19, and therefore in front of windows 9, to restore correct operation of detecting device 2. When reels 13 run out, drums 21, 22, accessible by opening covers 38*a*, 38*b*, can be changed quickly and easily. Alternatively, cleaning units 11 may be replaced entirely, by detaching the units from respective casings 8. In which case, fasteners 28 are reversible, and covers 38 may be dispensed with.

As will be appreciated by any skilled technician, cleaning units 11 may be of modular design for direct assembly to the outside of casings 8, as stated previously, or, according to one possible variation, may be formed directly inside casings 8. In the latter case, drums 21, 22 of each cleaning unit 11 will be housed inside the same casing 8 housing emitter 4 or receiver 5, and box body 20 will therefore be defined by a portion of casing 8 provided with removable cover 38.

It should be appreciated that changes could be made to the embodiments described above without departing from the inventive concepts thereof. It should be understood, therefore, that this invention is not limited to the particular embodiments disclosed, but it is intended to cover modifications within the spirt and scope of the present invention as defined by the appended claims.

What is claimed is:

1. An automatic cleaning device for a vehicle traffic detecting device and comprising at least one cleaning unit including:

a fastener fastening the cleaning unit to a casing of the detecting device;

a dispenser dispensing a transparent film;

a contoured guide defining a path along which the dispensed film resides, a portion of the defined path being located in front of an element of the detecting device and thereby positioning a portion of the dispensed film in front of the element of the detecting device;

an actuator for moving the dispensed film along the defined path; and a controller for automatically activating the actuator in response to a predetermined signal from the detecting device signifying that the portion of the dispensed film currently in front of the element of the detecting device is fouled, the actuator being activated by the controller to move the dispensed film a distance along the defined path such that the fouled portion of the dispensed film is moved beyond the front of the element of the detecting device and the portion of the dispensed film newly in front of the element of the detecting device is clean.

2. The cleaning device of claim 1 wherein the cleaning unit comprises:

a box body having an opening, the portion of the defined path located in front of the element of the detecting device also being located in front of the opening of the box body;

a first drum housed within the box body onto which the film is wound and defining an end point of the path; and a second drum housed within the box body from which the film is unwound and defining a starting point of the path.

3. The cleaning device of claim 2 wherein the box body has a removable cover enabling access to and possible replacement of the first and second drums.

4. The cleaning device of claim 2 wherein the fastener is a reversible fastener enabling removable connection of the box body and the casing of the detecting device.

5. The cleaning device of claim 2 wherein the box body has first and second hollow bodies respectively housing the first and the second drums, the hollow bodies being located on opposite sides of the opening of the box body and having respective gaps corresponding to the defined path.

6. The cleaning device of claim 5 wherein the hollow bodies are box elements constructed as bent sheet metal, wherein the hollow bodies are connected mechanically to each other at respective longitudinal ends by a bottom plate and by a top plate, the top and bottom plates each defining apertures within which rotate respective rotation pins of the drums, and wherein the box body further has a cover box enclosing at least the top plate and the hollow bodies.

7. The cleaning device of claim 6 wherein the actuator has a motor and a transmission coupling the motor to the first drum, the motor and transmission being housed within the cover box.

8. The cleaning device of claim 1 comprising first and second cleaning units, the portion of the defined path of the first cleaning unit being located in front of a first element of the detecting device, and the portion of the defined path of the second cleaning unit being located in front of a second element of the detecting device, the controllers of the first and second cleaning units being a common controller that automatically activates the respective actuators of the first and second cleaning units in response to a predetermined signal from the detecting device signifying that the portion of the dispensed film currently in front of at least one of the first and second elements of the detecting device is fouled.

9. An integrated assembly comprising a vehicle traffic detecting device and an automatic cleaning device, the detecting device comprising an emitter and a receiver facing each other and respectively emitting and receiving a beam of electromagnetic radiation along opposite ends of a beam path, the cleaning device having first and second cleaning units for respectively cleaning the emitter and the receiver, the cleaning units each including:

a fastener fastening the cleaning unit to a casing of the detecting device;

a dispenser dispensing a transparent film;

a contoured guide defining a film path along which the dispensed film resides, a portion of the defined film path being located in front of the emitter/receiver of the detecting device and thereby positioning a portion of the dispensed film in front of the emitter/receiver of the detecting device; and an actuator for moving the dispensed film along the defined film path, the cleaning device further having a controller for automatically activating the actuators of the cleaning units in response to a predetermined signal from the detecting device signifying that at least one of the portions of the dispensed films currently in front of the emitter and receiver of the detecting device is fouled, the actuators of the cleaning units being activated by the controller to move each of the dispensed films a distance along the defined film path such that the fouled portion of the dispensed film is moved beyond the front of the emitter/receiver of the detecting device and the portion of the dispensed film newly in front of the emitter/receiver of the detecting device is clean.

10. The integrated assembly of claim 9 wherein the emitter and the receiver are each housed in a respective casing, each casing having a window located at the emitter/receiver and aligned along the beam path, each contoured guide defining the respective film path such that the dispensed film at the portion of the defined film path located in front of the emitter/receiver closes the respective window.

11. The integrated assembly of claim 9 wherein each cleaning unit comprises:

a box body having an opening, the portion of the defined path located in front of the emitter/receiver of the detecting device also being located in front of the opening of the box body;

a first drum housed within the box body onto which the film is wound and defining an end point of the path; and a second drum housed within the box body from which the film is unwound and defining a starting point of the path.

12. The integrated assembly of claim 11 wherein the box body has a removable cover enabling access to and possible replacement of the first and second drums.

13. The integrated assembly of claim 12 wherein the first and second drum of each cleaning unit are housed within the respective casing housing the emitter/receiver, the box body of the cleaning unit being defined by a portion of the casing having the removable cover.

14. The integrated assembly of claim 9 wherein each cleaning unit is of modular design for direct assembly to an outside portion of the casing housing the emitter/receiver.

15. The integrated assembly of claim 9 wherein the controller activates the actuators when the beam from the emitter fails to be received by the receiver for a continuous period of time over and above a predetermined minimum value.

16. The integrated assembly of claim 9 wherein the detecting device is an optical device, the emitter generating a light beam and the receiver receiving the light beam and generating a signal when the light beam is cut off.

* * * * *